US006521577B1

(12) United States Patent
Ofosu-Asante et al.

(10) Patent No.: US 6,521,577 B1
(45) **Date of Patent: *Feb. 18, 2003**

(54) HAND WASHING DETERGENT COMPOSITIONS

(75) Inventors: Kofi Ofosu-Asante, Cincinnati, OH (US); Joanna Margaret Clarke, Brussels (BE); Robert Owens, Cincinnati, OH (US); Artemio Castro, West Chester, OH (US); Gary Kenneth Embleton, Princeton, NJ (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/890,673

(22) PCT Filed: Feb. 8, 2000

(86) PCT No.: PCT/US00/03230

§ 371 (c)(1),
(2), (4) Date: Aug. 3, 2001

(87) PCT Pub. No.: WO00/46330

PCT Pub. Date: Aug. 10, 2000

Related U.S. Application Data

(60) Provisional application No. 60/118,990, filed on Feb. 8, 1999.

(51) Int. Cl.[7] ..... C11D 1/02; C11D 1/75; C11D 1/83; C11D 3/37

(52) U.S. Cl. ..... 510/237; 510/423; 510/424; 510/427; 510/433; 510/434; 510/435; 510/499; 510/503

(58) Field of Search ..... 510/237, 423, 510/424, 427, 433, 435, 434, 499, 503

(56) References Cited

U.S. PATENT DOCUMENTS

| | | | | |
|---|---|---|---|---|
| 4,077,896 A | | 3/1978 | Bunegar et al. | |
| 4,556,509 A | | 12/1985 | Demangeon et al. | |
| 5,484,555 A | | 1/1996 | Schepers | |
| 5,990,065 A | * | 11/1999 | Vinson et al. | 510/237 |
| 6,069,122 A | * | 5/2000 | Vinson et al. | 510/235 |
| 6,207,631 B1 | * | 3/2001 | Kasturi et al. | 510/237 |

FOREIGN PATENT DOCUMENTS

| | | |
|---|---|---|
| EP | 0 816 479 A1 | 1/1998 |
| JP | 2550036 B | 10/1996 |
| WO | WO 92/08777 | 5/1992 |
| WO | WO 95/19951 | 7/1995 |
| WO | WO 98/28393 | 7/1998 |
| WO | WO 99/63034 | 12/1999 |

* cited by examiner

*Primary Examiner*—Gregory Delcotto
(74) *Attorney, Agent, or Firm*—Kevin L. Waugh

(57) ABSTRACT

Hand dishwashing compositions comprising a low molecular weight organic diamine having a pK1 and a pK2 value in the range of from 8 10 11.5, an anionic surfactant, an amine oxide, and magnesium ions, said magnesium being present at an equimolar or less than equimolar amount of said diamine.

17 Claims, No Drawings

HAND WASHING DETERGENT COMPOSITIONS

This application claim priority under 35 USC 119(e) to U.S. provisional application No. 60/118,990, filed Feb. 8, 1999.

FIELD OF THE INVENTION

The present invention relates to detergent compositions containing low molecular weight organic diamines and magnesium. More particularly, the invention is directed to detergent compositions for hand dishwashing which have improved grease removal performance and benefits in sudsing. The detergents of this invention also have improved low temperature stability properties and superior dissolution, as well as improved tough food stain removal, and antibacterial properties.

BACKGROUND OF THE INVENTION

Typical commercial hand dishwashing compositions incorporate divalent ions (Mg, Ca) to ensure adequate grease performance in soft water. However, the presence of divalent ions in formulas containing anionic, nonionic, or additional surfactants (e.g., amine oxide, alkyl ethoxylate, alkanoyl glucose amide, alkyl betaines) leads to slower rates of product mixing with water (and hence poor flash foam), poor rinsing, and poor low temperature stability properties. Moreover, preparation of stable dishwashing detergents containing Ca/Mg is very difficult due to the precipitation issues associated with Ca and Mg as pH increases. Additionally, hand dishwashing formulations which contain magnesium as well as amine oxide and an anionic surfactant have the added stability problem that at low temperatures, typically about 5° C. or less, the product solidifies. This eliminates a potentially useful surfactant system from any possible combinations with magnesium.

Sodium chloride is a typical additive to hand dishwashing compositions. It is a common formulation additive, typically as an electrolyte to make the composition overall electrically neutral. However, this addition of sodium chloride has it's drawbacks as it is believed to increase the corrosion of the metal surfaces which the compositions containing sodium chloride contact. Reduction, if not total elimination of this added electrolyte is highly desired by formulators.

Consequently, there remains the need for a detergent composition suitable for hand dishwashing, which is stable at low temperatures, and additionally can provide grease removal and tough food cleaning benefits, in soft water and at pH's, typically pH 9 or lower, where a conventional Ca/Mg system would be unstable and not provide grease removal and tough food cleaning benefits. Furthermore, the need remains for a way of reducing or totally eliminating sodium chloride in hand dishwashing compositions.

BACKGROUND ART

U.S. Pat. Nos. 4,556,509, 4,077,896 and 5,484,555; and JP 63131124-A 88/06/03.

SUMMARY OF THE INVENTION

It has now been determined that the use of certain organic diamines, as outlined in detail below, in combination with magnesium ions at less than or equimolar amounts leads to improved cleaning of tough food stains and removal of grease/oil when compared to the use of diamine alone in soft water in conventional detergent compositions.

Unexpectedly, these organic diamines also improve suds stability in the presence of soils, esp. soils containing fatty acids and proteins. Furthermore, it has been surprisingly found that this novel combination of magnesium salt and diamine means that the addition of sodium chloride can be reduced, if not totally eliminated.

In accordance with a first aspect of the present invention a hand dishwashing detergent composition is provided for, the composition comprises:

a) a low molecular weight organic diamine having a pK1 and a pK2, wherein the pK1 and the pK2 of said diamine are both in the range of from about 8.0 to about 11.5;

b) an anionic surfactant;

c) an amine oxide;

d) magnesium ions; and wherein the pH (as measured as 10% aqueous solution) is from about 5.0 to about 12.5; and the magnesium ions are present at an equimolar or less than equimolar amount of the diamine wherein mole ratio of the anionic surfactant to the amine oxide to the diamine is from about 100:40:1 to about 9:0.5:1.

In accordance with a second aspect of the present invention a hand dishwashing detergent composition is provided for, the composition comprises:

a) from about 0.1% to about 15%, by weight of an organic diamine having a molecular weight less than or equal to 400 g/mol;

b) an anionic surfactant;

c) amine oxide;

d) from about 0.01% to about 5% by weight of magnesium ions; and e) less than about 1% by weight of sodium chloride;

wherein the pH (as measured as 10% aqueous solution) is from about 5.0 to about 12.5; and the magnesium ions are present at an equimolar or less than equimolar amount of the diamine wherein mole ratio of the anionic surfactant to the amine oxide to the diamine is from about 100:40:1 to about 9:0.5:1.

It has been surprisingly found that when magnesium ions are used in the present inventive hand dishwashing compositions at equimolar or less than equimolar amount of diamine the soft water cleaning of the composition improves. Furthemore, this inventive combination of magnesium and diamine surprisingly does not suffer from the stability problems when in combination with amine oxide and an anionic surfactant. The compositions of the present invention are stable at 0° C., where as compositions with greater than equimolar amounts of magnesium than diamine (and outside the scope of the present invention) show no such stability, and fail after a few days at 0° C.

Accordingly, it is an aspect of the present invention to provide novel cleaning compositions as well as methods of using these novel compositions. These, and other, aspects, features and advantages will be clear from the following detailed description and the appended claims. All parts, percentages and ratios used herein are expressed as percent weight unless otherwise specified. All documents cited are, in relevant part, incorporated herein by reference.

DETAILED DESCRIPTION OF THE INVENTION

DEFINITIONS

The present detergent compositions comprise an "effective amount" or a "grease removal-improving amount" of individual components defined herein. By an "effective amount" of the diamines herein and adjunct ingredients herein is meant an amount which is sufficient to improve, either directionally or significantly at the 90% confidence level, the performance of the cleaning composition against at least some of the target soils and stains. Thus, in a composition whose targets include certain grease stains, the formulator will use sufficient diamine to at least directionally improve cleaning performance against such stains. Importantly, in a fully-formulated detergent the diamine can be used at levels which provide at least a directional improvement in cleaning performance over a wide variety of soils and stains, as will be seen from the examples presented hereinafter.

As noted, the diamines are used herein in detergent compositions in combination with detersive surfactants at levels which are effective for achieving at least a directional improvement in cleaning performance. In the context of a hand dishwashing composition, such "usage levels" can vary depending not only on the type and severity of the soils and stains, but also on the wash water temperature, the volume of wash water and the length of time the dishware is contacted with the wash water.

Since the habits and practices of the users of detergent compositions show considerable variation, the composition will preferably contain at least about 0.1%, more preferably at least about 0.2%, even more preferably, at least about 0.25%, even more preferably still, at least about 0.5% by weight of said composition of diamine. The composition will also preferably contain no more than about 15%, more preferably no more than about 10%, even more preferably, no more than about 6%, even more preferably, no more than about 5%, even more preferably still, no more than about 1.5% by weight of said composition of diamine.

In one of its several aspects, this invention provides a means for enhancing the removal of greasy/oily soils by combining the specific diamines of this invention with surfactants. Greasy/oily "everyday" soils are a mixture of triglycerides, lipids, complex polysaccharides, fatty acids, inorganic salts and proteinaceous matter.

Depending on consumer preferences, the compositions herein may be formulated at viscosities of over about 50, preferably over about 100 centipoise, and more preferably from about 100 to about 400 centipoise. For European formulations, the compositions may be formulated at viscosites of up to about 1000 centipoise.

Moreover, the superior rate of dissolution achieved by divalent ion elimination even allows the formulator to make hand dishwashing detergents, especially compact formulations, at even significantly higher viscosities (e.g., 1,000 centipoise or higher) than conventional formulations while maintaining excellent dissolution and cleaning performance. This has significant potential advantages for making compact products with a higher viscosity while maintaining acceptable dissolution. By "compact" or "Ultra" is meant detergent formulations with reduced levels of water compared to conventional liquid detergents. The level of water is less than 50%, preferably less than 30% by weight of the detergent compositions. Said concentrated products provide advantages to the consumer, who has a product which can be used in lower amounts and to the producer, who has lower shipping costs.

Soft water: is defined herein as water which has a hardness of less than about 15 gpg, preferably less than about 10 gpg, more preferably, less than about 7 gpg, more preferably less than about 2 gpg, even more preferably about 0 gpg ("gpg" is a measure of water hardness that is well known to those skilled in the art, and it stands for "grains per gallon").

Diamines

It is preferred that the diamines used in the present invention are substantially free from impurities. That is, by "substantially free" it is meant that the diamines are over 95% pure, i.e., preferably 97%, more preferably 99%, still more preferably 99.5%, free of impurities. Examples of impurities which may be present in commercially supplied diamines include 2-Methyl-1,3-diaminobutane and alkylhydropyrimidine. Further, it is believed that the diamines should be free of oxidation reactants to avoid diamine degradation and ammonia formation. Additionally, if amine oxide and/or other surfactants are present, the amine oxide or surfactant should be hydrogen peroxide-free, especially when the compositions contain enzymes. The preferred level of hydrogen peroxide in the amine oxide or surfactant paste of amine oxide is 0–40 ppm, more preferably 0–15 ppm. Amine impurities in amine oxide and betaines, if present, should be minimized to the levels referred above for hydrogen peroxide. However, conventional amine oxides, namely those which are not free of hydrogen peroxide, can be used in the compositions of the present invention.

Making the compositions free of hydrogen peroxide is important when the compositions contain an enzyme. The peroxide can react with the enzyme and destroy any performance benefits the enzyme adds to the composition. Even small amounts of hydrogen peroxide can cause problems with enzyme containing formulations. However, the diamine can react with any peroxide present and act as an enzyme stabilizer and prevent the hydrogen peroxide from reacting with the enzyme. The only draw back of this stabilization of the enzymes by the diamine is that the nitrogen compounds produced are believed to cause the malodors which can be present in diamine containing compositions. Having the diamine act as an enzyme stabilizer also prevents the diamine from providing the benefits to the composition for which it was originally put in to perform, namely, grease cleaning, sudsing, dissolution and low temperature stability. Therefore, it is preferred to minimize the amount of hydrogen peroxide present as an impurity in the inventive compositions either by using components which are substantially free of hydrogen peroxide and/or by using non-diamine antioxidants even though the diamine can act as an enzyme stabilizer, because of the possible generation of malodorous compounds and the reduction in the amount of diamine available present to perform its primary role.

It is further preferred that the compositions of the present invention be "malodor" free. That is, that the odor of the headspace does not generate a negative olfactory response from the consumer. This can be achieved in many ways, including the use of perfumes to mask any undesirable odors, the use of stabilizers, such as antioxidants, chelants etc., and/or the use of diamines which are substantially free of impurities. It is believed, without wanting to being limited by theory, that it is the impurities present in the diamines that are the cause of most of the malodors in the compositions of the present invention. These impurities can form during the preparation and storage of the diamines. They can also form during the preparation and storage of the inventive composition. The use of stabilizers such as antioxidants and chelants inhibit and/or prevent the formation of these impurities in the composition from the time of preparation to ultimate use by the consumer and beyond. Hence, it is most preferred to remove, suppress and/or prevent the formation of these malodors by the addition of perfumes, stabilizers and/or the use of diamines which are substantially free from impurities.

One type of preferred organic diamines are those in which pK1 and pK2 are in the range of about 8.0 to about 11.5, preferably in the range of about 8.4 to about 11, even more preferably from about 8.6 to about 10.75. Preferred materials for performance and supply considerations are 1,3-bis (methylamine)-cyclohexane, 1,3 propane diamine (pK1=10.5; pK2=8.8), 1,6 hexane diamine (pK1=11; pK2=10), 1,3 pentane diamin (Dytek EP) (pK1=10.5; pK2=8.9), 2-methyl 1,5 pentane diamine (Dytek A) (pK1=11.2; pK2=10.0). Other preferred materials are the primary/primary diamines with alkylene spacers ranging from C4 to C8. In general, it is believed that primary diamines are preferred over secondary and tertiary diamines.

Definition of pK1 and pK2

As used herein, "pKa1" and "pKa2" are quantities of a type collectively known to those skilled in the art as "pKa" pKa is used herein in the same manner as is commonly known to people skilled in the art of chemistry. Values referenced herein can be obtained from literature, such as from "Critical Stability Constants: Volume 2, Amines" by Smith and Martel, Plenum Press, NY and London, 1975. Additional information on pKa's can be obtained from relevant company literature, such as information supplied by Dupont, a supplier of diamines.

As a working definition herein, the pKa of the diamines is specified in an all-aqueous solution at 25° C. and for an ionic strength between 0.1 to 0.5 M. The pKa is an equilibrium constant which can change with temperature and ionic strength; thus, values reported in the literature are sometimes not in agreement depending on the measurement method and conditions. To eliminate ambiguity, the relevant conditions and/or references used for pKa's of this invention are as defined herein or in "Critical Stability Constants: Volume 2, Amines". One typical method of measurement is the potentiometric titration of the acid with sodium hydroxide and determination of the pKa by suitable methods as described and referenced in "The Chemist's Ready Reference Handbook" by Shugar and Dean, McGraw Hill, NY, 1990.

It has been determined that substituents and structural modifications that lower pK1 and pK2 to below about 8.0 are undesirable and cause losses in performance. This can include substitutions that lead to ethoxylated diamines, hydroxy ethyl substituted diamines, diamines with oxygen in the beta (and less so gamma) position to the nitrogen in the spacer group (e.g., Jeffamine EDR 148). In addition, materials based on ethylene diamine are unsuitable.

Some of the diamines useful herein can be defined by the following structure:

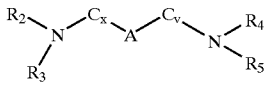

wherein $R_{2-5}$ are independently selected from H, methyl, —$CH_3CH_2$, and ethylene oxides; $C_x$ and $C_y$ are independently selected from methylene groups or branched alkyl groups where x+y is from about 3 to about 6; and A is optionally present and is selected from electron donating or withdrawing moieties chosen to adjust the diamine pKa's to the desired range. If A is present, then x and y must both be 1 or greater.

Alternatively the diamines can be those organic diamines with a molecular weight less than or equal to 400 g/mol. It is preferred that these diamines have the formula:

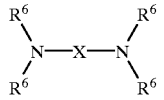

wherein each $R^6$ is independently selected from the group consisting of hydrogen, $C_1$–$C_4$ linear or branched alkyl, alkyleneoxy having the formula:

$$—(R^7O)_mR^8$$

wherein $R^7$ is $C_2$–$C_4$ linear or branched alkylene, and mixtures thereof; $R^8$ is hydrogen, $C_1$–$C_4$ alkyl, and mixtures thereof; m is from 1 to about 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$—(R^7O)_mR^7—$$

wherein $R^7$ and m are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a $pK_a$ greater than about 8; and iii) mixtures of (i) and (ii)

provided said diamine has a $pK_a$ of at least about 8.

Examples of preferred diamines include the following: dimethyl aminopropyl amine, 1,6-hexane diamine, 1,3 propane diamine, 2-methyl 1,5 pentane diamine, 1,3-Pentanediamine (available under the tradename Dytek EP), 1,3-diaminobutane, 1,2-bis(2-aminoethoxy)ethane, (available under the tradename Jeffamine EDR 148), Isophorone diamine, 1,3-bis(methylamine)-cyclohexane, and mixtures thereof.

Surfactant

The compositions according to the present invention contain a surfactant, preferably selected from: anionic surfactants, nonionic surfactants; amphoteric surfactants; zwiterionic surfactants and mixtures thereof.

A wide range of these surfactants can be used in the compositions used in the methods of the present invention. A typical listing of anionic, nonionic, amphoteric and zwitterionic classes, and species of these surfactants, is given in U.S. Pat. No. 3,664,961 issued to Norris on May 23, 1972 and in "Surface Active Agents and Detergents" (Vol. I and II by Schwartz, Perry and Berch). Amphoteric surfactants are also described in detail in "Amphoteric Surfactants, Second Edition", E. G. Lomax, Editor (published 1996, by Marcel Dekker, Inc.)

The composition will preferably contain at least about 0.01%, more preferably at least about 0.1%, even more preferably still, at least about 0.2%, even more preferably still, at least about 0.5% by weight of said composition of surfactant. The composition will also preferably contain no more than about 90%, more preferably no more than about 70%, even more preferably, no more than about 60%, even more preferably, no more than about 35% by weight of said composition of surfactant.

Anionic Surfactants

The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof.

When present, anionic surfactant will be present typically in an effective amount. More preferably, the composition may contain at least about 0.5%, more preferably at least about 5%, even more preferably still, at least about 10% by weight of said composition of anionic surfactant. The composition will also preferably contain no more than about 90%, more preferably no more than about 50%, even more preferably, no more than about 30% by weight of said composition of anionic surfactant.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. The anionic surfactant component may comprise alkyl sulfates and alkyl ether sulfates derived from conventional alcohol sources, e.g., natural alcohols, synthetic alcohols such as those sold under the trade name of NEODOL™, ALFOL™, LIAL™, LUTENSOL™ and the like. Alkyl ether sulfates are also known as alkyl polyethoxylate sulfates.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

One type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

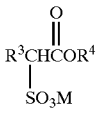

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al at Column 23, line 58 through Column 29, line 23.

Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: alkyl ethoxylate, alkanoyl glucose amide, $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), and mixtures thereof When present, nonionic surfactant will be present typically in an effective amount. More preferably, the composition may contain at least about 0.1%, more preferably at least about 0.2%, even more preferably still, at least about 0.5% by weight of said composition of nonionic surfactant. The composition will also preferably contain no more than about 20%, more preferably no more than about 15%, even more preferably, no more than about 10% by weight of said composition of nonionic surfactant.

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton® X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$–$C_{15}$ linear secondary alcohol with 9 moles ethylene oxide), Tergitol® 24-L-6 NMW (the condensation product of $C_{12}$–$C_{14}$ primary alcohol with 6 moles ethylene oxide with a narrow molecular weight distribution), both marketed by Union Carbide Corporation; Neodol® 45-9 (the condensation product of $C_{14}$–$C_{15}$ linear alcohol with 9 moles of ethylene oxide), Neodol® 23-6.5 (the condensation product of $C_{12}$–$C_{13}$ linear alcohol with 6.5 moles of ethylene oxide), Neodol® 45-7 (the condensation product of $C_{14}$–$C_{15}$ linear alcohol with 7 moles of ethylene oxide), Neodol® 45-4 (the condensation product of $C_{14}$–$C_{15}$ linear alcohol with 4 moles of ethylene oxide), marketed by Shell Chemical Company, and Kyro® EOB (the condensation product of $C_{13}$–$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic® surfactants, marketed by BASF.

The condensation products of ethylene oxide with the product resulting from the reaction of propylene oxide and ethylenediamine. The hydrophobic moiety of these products consists. of the reaction product of ethylenediamnine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic® compounds, marketed by BASF.

Examples of ethylene oxide-propylene oxide block co-polymers suitable for uses herein are described in greater detail in Pancheri/Mao; U.S. Pat. No. 5,167,872; Issued Dec. 2, 1992. This patent is incorporated herein by reference.

The preferred alkylpolyglycosides have the formula $$R^2O(C_nH_{2n}O)_t(\text{glycosyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyl, decyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexa-glucosides.

Another type of suitable nonionic surfactant comprises the polyhydroxy fatty acid amides. These materials are more fully described in Pan/Gosselink; U.S Pat. No. 5,332,528; Issued Jul. 26, 1994, which is incorporated herein by reference. These polyhydroxy fatty acid amides have a general structure of the formula:

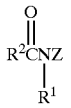

wherein $R^1$ is H, $C_1$–$C_4$ hydrocarbyl, 2-hydroxy ethyl, 2-hydroxy propyl, or a mixture thereof, preferably $C^1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

R' can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palnitamide, tallowamide, etc.

Z can be 1-deoxyglucityl, 2-deoxyfructityl, 1-deoxymaltityl, 1-deoxylactityl, 1-deoxygalactity, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G. B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Examples of such surfactants include the $C_{10}$–$C_{18}$ N-methyl, or N-hydroxypropyl, glucamides. The N-propyl through N-hexyl $C_{12}$–$C_{16}$ glucamides can be used for lower sudsing performance.

Preferred amides are $C_8$–$C_{20}$ ammonia amides, monoethanolamides, diethanolamides, and isopropanolamides.

Another suitable class of surfactants are the alkanol amide surfactants, including the ammonia, monoethanol, and diethanol amides of fatty acids having an acyl moiety containing from about 8 to about 18 carbon atoms. These materials are represented by the formula:

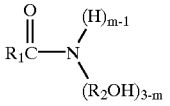

wherein $R_1$ is a saturated or unsaturated, hydroxy-free aliphatic hydrocarbon group having from about 7 to 21, preferably from about 11 to 17 carbon atoms; $R_2$ represents a methylene or ethylene group; and m is 1, 2, or 3, preferably 1. Specific examples of such amides are monoethanol amine coconut fatty acid amide and diethanolamine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanolamides and diethanolamides of $C_{12-14}$ fatty acids are preferred.

Amphoteric Surfactants

Amphoteric surfactants may optionally be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 for examples of ampholytic surfactants. Preferred amphoteric include $C_{12}$–$C_{18}$ betaines and sulfobetaines ("sultaines"), $C_{10}$–$C_{18}$ amine oxides, and mixtures thereof.

When present, amphoteric surfactant will be present typically in an effective amount. More preferably, the composition may contain at least about 0.1%, more preferably at least about 0.2%, even more preferably still, at least about 0.5% by weight of said composition of amphoteric surfactant. The composition will also preferably contain no more than about 20%, more preferably no more than about 15%, even more preferably, no more than about 10% by weight of said composition of amphoteric surfactant.

Amine oxides are amphoteric surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Preferred amine oxide surfactants have the formula

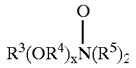

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

When present, amine oxide surfactant will be present typically in an effective amount. More preferably, the composition may contain at least about 0.1%, more preferably at least about 0.2%, even more preferably still, at least about 0.5% by weight of said composition of amine oxide surfactant. The composition will also preferably contain no more than about 20%, more preferably no more than about 15%, even more preferably, no more than about 10% by weight of said composition of amine oxide surfactant.

Examples of suitable amine oxide surfactants are given in "Surface Active Agents and Detergents" (Vol. I and II by Schwartz, Perry and Berch).

Suitable betaine surfactants include those of the general formula:

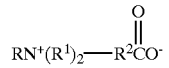

wherein R is a hydrophobic group selected from alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amino or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate. Other suitable amidoalkylbetaines are disclosed in U.S. Pat. Nos. 3,950,417; 4,137,191; and 4,375,421; and British Patent GB No. 2,103,236, all of which are incorporated herein by reference.

Zwitterionic Surfactants

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 for examples of zwitterionic surfactants. Ampholytic and zwitterionic surfactants are generally used in combination with one or more anionic and/or nonionic surfactants.

Ratio of Anionic to Amine Oxide to Diamine

In the compositions of the present invention the mole ratio of the anionic surfactant: amine oxide: diamine is from about 100:40:1 to about 9:0.5:1, preferably from about 27:8:1 to about 11:3:1. It has been found that detergent compositions containing anionic surfactant, amine oxide and diamine in this specific mole ratio range provide improved low temperature stability, deliver better grease removal and tough food cleaning benefits at pH less than 12.5, and improved hard water cleaning.

Magnesium Ions

The presence of magnesium (divalent) ions improves the cleaning of greasy soils for various compositions, i.e., compositions containing alkyl ethoxy sulfates and/or polyhydroxy fatty acid amides. This is especially true when the compositions are used in softened water that contains few divalent ions. It is believed, while not wanting to be limited by theory, that, magnesium ions increase the packing of the surfactants at the oil/water interface, thereby reducing interfacial tension and improving grease cleaning. Compositions of the invention herein containing magnesium ions exhibit good grease removal, manifest mildness to the skin, and provide good storage stability.

The composition will preferably contain at least about 0.01%, more preferably at least about 0.015%, more preferably at least about 0.02%, even more preferably still, at least about 0.025% by weight of said composition of magnesium ions. The cleaning composition will also preferably contain no more than about 5%, more preferably no more than about 2.5%, more preferably no more than about 1%, even more preferably, no more than about 0.05% by weight of said composition of magnesium ions. In any event the amount of magnesium ions present will always be equimolar or less than the amount of diamine present in the composition.

Preferably, the magnesium ions are added as a hydroxide, chloride, acetate, formate, oxide or nitrate salt to the compositions of the present invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed hereinafter may also be necessary.

It is an essential part of the present invention that the magnesium ions are present in the hand dishwashing composition at an equimolar or less than equimolar amount of said diamine.

Sodium Chloride

It has been surprisingly found that the combination of diamine with an equimolar or less than equimolar amount of a magnesium salt means that the amount of sodium chloride needed to be added to the composition can be substantially reduced or even totally eliminated.

In one aspect of the present invention compositions of the present invention contain less than about 1%, more preferably less than about 0.75%, more preferably less than about 0.65%, more preferably less than about 0.5%, more preferably less than about 0.3% by weight of the composition of sodium chloride.

Optional Detergent Ingredients

Some optional ingredients suitable for incorporation in the compositions herein include, but not limited to, enzymes such as protease, suds stabilizing polymers, builders and a stabilizing system for any enzymes, etc. These and other optional ingredients are described as follows:

Builder

The compositions according to the present invention may further comprise a builder system. Any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include maleic acid, citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Mixtures of these suitable polycarboxylates builders is also envisioned, such as a mixture of maleic acid and citric acid. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

The composition will preferably contain at least about 0.2%, more preferably at least about 0.5%, more preferably at least about 3%, even more preferably still, at least about 5% by weight of the composition of builder. The cleaning composition will also preferably contain no more than about 50%, more preferably no more than about 40%, more preferably no more than about 30%, even more preferably, no more than about 25% by weight of the composition of builder.

Enzymes

Detergent compositions of the present invention may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase.

The composition will preferably contain at least about 0.0001%, more preferably at least about 0.0005%, even more preferably still, at least about 0.001% by weight of the composition of enzyme. The cleaning composition will also preferably contain no more than about 5%, more preferably no more than about 2%, even more preferably, no more than about 1% by weight of the composition of enzyme.

Proteolytic Enzyme

The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase® (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Also proteases described in our co-pending application U.S. Ser. No. 08/136,797 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, according to the numbering of Bacillus amyloliquefaciens subtilisin, as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzyme may be incorporated into the compositions in accordance with the invention at a level of from 0.0001% to 2% active enzyme by weight of the composition.

The composition will preferably contain at least about 0.0001%, more preferably at least about 0.0002%, more preferably at least about 0.0005%, even more preferably still, at least about 0.001% of active enzyme by weight of the composition of protease enzyme. The composition will also preferably contain no more than about 2%, more preferably no more than about 0.5%, more preferably no more than about 0.1%, even more preferably, no more than about 0.05% of active enzyme by weight of the composition of protease enzyme.

Amylase

Amylases (α and/or β) can be included for removal of carbohydrate-based stains. Suitable amylases are Termamy® (Novo Nordisk), Fungamyl® and BAN® (Novo Nordisk). The enzymes may be of any suitable origin, such as vegetable, animal, bacterial, fungal and yeast origin.

The composition will preferably contain at least about 0.0001%, more preferably at least about 0.0002%, more preferably at least about 0.0005%, even more preferably still, at least about 0.001% of active enzyme by weight of the composition of amylase enzyme. The composition will also preferably contain no more than about 2%, more preferably no more than about 0.5%, more preferably no more than about 0.1%, even more preferably, no more than about 0.05% of active enzyme by weight of the composition of amylase enzyme.

Amylase enzymes also include those described in WO95/26397 and in co-pending application by Novo Nordisk PCT/DK96/00056. Other specific amylase enzymes for use in the detergent compositions of the present invention therefore include:

(a) α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Such Phadebas® α-amylase activity assay is described at pages 9–10, WO95/26397.

(b) α-amylases according (a) comprising the amino sequence shown in the SEQ ID listings in the above cited reference or an α-amylase being at least 80% homologous with the amino acid sequence shown in the SEQ ID listing.

(c) α-amylases according (a) obtained from an alkalophilic Bacillus species, comprising the following amino sequence in the N-terminal: His-His-Asn-Gly-Thr-Asn-Gly-Thr-Met-Met-Gln-Tyr-Phe-Glu-Trp-Tyr-Leu-Pro-Asn-Asp.

A polypeptide is considered to be X% homologous to the parent amylase if a comparison of the respective amino acid sequences, performed via algorithms, such as the one described by Lipman and Pearson in Science 227, 1985, p. 1435, reveals an identity of X%

(d) α-amylases according (a–c) wherein the α-amylase is obtainable from an alkalophilic Bacillus species; and in particular, from any of the strains NCIB 12289, NCIB 12512, NCIB 12513 and DSM 935.

In the context of the present invention, the term "obtainable from" is intended not only to indicate an amylase produced by a Bacillus strain but also an amylase encoded by a DNA sequence isolated from such a Bacillus strain and produced in an host organism transformed with said DNA sequence.

(e) α-amylase showing positive immunological cross-reactivity with antibodies raised against an α-amylase having an amino acid sequence corresponding respectively to those α-amylases in (a–d).

(f) Variants of the following parent α-amylases which (i) have one of the amino acid sequences shown in corresponding respectively to those α-amylases in (a–e), or (ii) displays at least 80% homology with one or more of said amino acid sequences, and/or displays immunological cross-reactivity with an antibody raised against an α-amylase having one of said amino acid sequences, and/or is encoded by a DNA sequence which hybridizes with the same probe as a DNA sequence encoding an α-amylase having one of said amino acid sequence; in which variants:

1. at least one amino acid residue of said parent α-amylase has been deleted; and/or
2. at least one amino acid residue of said parent α-amylase has been replaced by a different amino acid residue; and/or
3. at least one amino acid residue has been inserted relative to said parent α-amylase;

said variant having an α-amylase activity and exhibiting at least one of the following properties relative to said parent α-amylase: increased thermostability, increased stability towards oxidation, reduced Ca ion dependency, increased stability and/or α-amylolytic activity at neutral to relatively high pH values, increased α-amylolytic activity at relatively high temperature and increase or decrease of the isoelectric point (pI) so as to better match the pI value for α-amylase variant to the pH of the medium.

Said variants are described in the patent application PCT/DK96/00056.

Other amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents such as automatic dishwashing types, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, Mar. 13–17, 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

It is also possible to include an enzyme stabilization system into the compositions of the present invention when any enzyme is present in the composition.

Cellulases

The cellulases usable in the present invention include both bacterial or fungal cellulase. Suitable cellulases are disclosed in U.S. Pat. No. 4,435,307, Barbesgoard et al, which discloses fungal cellulase produced from *Humicola insolens*. Suitable cellulases are also disclosed in GB-A-2.075.028; GB-A-2.095.275 and DE-OS-2.247.832.

Examples of such cellulases are cellulases produced by a strain of *Humicola insolens* (*Humicola grisea* var. *thermoidea*), particularly the Humicola strain DSM 1800. Other suitable cellulases are cellulases originated from *Humicola insolens* having a molecular weight of about 50 KDa, an isoelectric point of 5.5 and containing 415 amino acids. Especially suitable cellulases are the cellulases having color care benefits. Examples of such cellulases are cellulases described in European patent application No. 91202879.2, filed Nov. 6, 1991 (Novo).

Peroxidase enzymes are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813 and in European Patent application EP No. 91202882.6, filed on Nov. 6, 1991.

Said cellulases and/or peroxidases are normally incorporated in the detergent composition at levels from 0.0001% to 2% of active enzyme by weight of the detergent composition.

The composition will preferably contain at least about 0.0001%, more preferably at least about 0.0002%, more preferably at least about 0.0005%, even more preferably still, at least about 0.001% of active enzyme by weight of the composition of cellulases and/or peroxidases enzyme. The composition will also preferably contain no more than about 2%, more preferably no more than about 0.5%, more preferably no more than about 0.1%, even more preferably, no more than about 0.05% of active enzyme by weight of the composition of cellulases and/or peroxidases enzyme.

Lipase

Suitable lipase enzymes include those produced by microorganisms of the Pseudomonas group, such as *Pseudomonas stutzeri* ATCC 19.154, as disclosed in British Patent 1,372,034. Suitable lipases include those which show a positive immunological cross-reaction with the antibody of the lipase, produced by the microorganism *Pseudomonas fluorescens* IAM 1057. This lipase is available from Amano Pharmaceutical Co. Ltd., Nagoya, Japan, under the trade name Lipase P "Amano," hereinafter referred to as "Amano-P". Further suitable lipases are lipases such as M1 Lipase® and Lipomax® (Gist-Brocades). Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein. Lipase and amylase variants stabilized against peroxidase enzymes are described in WO 9414951 A to Novo. See also WO 9205249 and RD 94359044.

Highly preferred lipases are the D96L lipolytic enzyme variant of the native lipase derived from *Humicola lanuginosa* as described in U.S. Ser. No. 08/341,826. (See also patent application WO 92/05249 viz. wherein the native lipase ex *Humicola lanuginosa* aspartic acid (D) residue at position 96 is changed to Leucine (L). According to this nomenclature said substitution of aspartic acid to Leucine in position 96 is shown as: D96L.) Preferably the *Humicola lanuginosa* strain DSM 4106 is used.

In spite of the large number of publications on lipase enzymes, only the lipase derived from *Humicola lanuginosa* and produced in *Aspergillus oryzae* as host has so far found widespread application as additive for washing products. It is available from Novo Nordisk under the tradename Lipolase® and Lipolase Ultra®, as noted above. In order to optimize the stain removal performance of Lipolase, Novo Nordisk have made a number of variants. As described in WO 92/05249, the D96L variant of the native *Humicola*

*lanuginosa* lipase improves the lard stain removal efficiency by a factor 4.4 over the wild-type lipase (enzymes compared in an amount ranging from 0.075 to 2.5 mg protein per liter). Research Disclosure No. 35944 published on Mar. 10, 1994, by Novo Nordisk discloses that the lipase variant (D96L) may be added in an amount corresponding to 0.001–100-mg (5–500,000 LU/liter) lipase variant per liter of wash liquor.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor).

The composition will preferably contain at least about 0.0001%, more preferably at least about 0.0002%, more preferably at least about 0.0005%, even more preferably still, at least about 0.001% of active enzyme by weight of the composition of lipase enzyme. The composition will also preferably contain no more than about 2%, more preferably no more than about 0.5%, more preferably no more than about 0.1%, even more preferably, no more than about 0.05% of active enzyme by weight of the composition of lipase enzyme.

Enzyme Stabilizing System

The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the protease or other enzymes used in the compositions herein. Such stabilizing systems can comprise calcium ion, boric acid, propylene glycol, short chain carboxylic acid, boronic acid, polyhydroxyl compounds and mixtures thereof such as are described in U.S. Pat. No. 4,261,868, Hora et al, issued Apr. 14, 1981; U.S. Pat. No. 4,404,115, Tai, issued Sep. 13, 1983; U.S. Pat. No. 4,318,818, Letton et al; U.S. Pat. No. 4,243,543, Guildert et al issued Jan. 6, 1981; U.S. Pat. No. 4,462,922, Boskamp, issued Jul. 31, 1984; U.S. Pat. No. 4,532,064, Boskamp, issued Jul. 30, 1985; and U.S. Pat. No. 4,537,707, Severson Jr., issued Aug. 27, 1985, all of which are incorporated herein by reference.

The composition will preferably contain at least about 0.001%, more preferably at least about 0.005%, even more preferably still, at least about 0.01% by weight of the composition of enzyme stabilizing system. The composition will also preferably contain no more than about 10%, more preferably no more than about 8%, no more than about 6% of active enzyme by weight of the composition of enzyme stabilizing system.

One stabilizing approach is the use of water-soluble sources of calcium and/or magnesium ions in the finished compositions which provide such ions to the enzymes. Calcium ions are generally more effective than magnesium ions and are preferred herein if only one type of cation is being used. Typical detergent compositions, especially liquids, will comprise from about 1 to about 30, preferably from about 2 to about 20, more preferably from about 8 to about 12 millimoles of calcium ion per liter of finished detergent composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the exemplified calcium salts may be used. Further increased levels of Calcium and/or Magnesium may of course be useful, for example for promoting the grease-cutting action of certain types of surfactant. However, it is especially preferred that the composition contain no added calcium ions, and even more preferred that the composition be free of calcium ions.

Another stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Additionally, from 0% to about 10%, preferably from about 0.01% to about 6% by weight, of chlorine bleach or oxygen bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbonate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used.

Polymeric Suds Stabilizer

The compositions of the present invention may optionally contain a polymeric suds stabilizer. These polymeric suds stabilizers provide extended suds volume and suds duration without sacrificing the grease cutting ability of the liquid detergent compositions. These polymeric suds stabilizers are selected from:

i) homopolymers of (N,N-dialkylamino)alkyl acrylate esters having the formula:

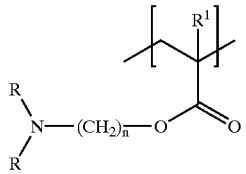

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

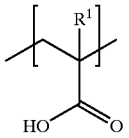

wherein $R^1$ is hydrogen, C1–C6 alkyl, and mixtures thereof, provided that the ratio of (ii) to (i) is from about 2 to 1 to about 1 to 2; The molecular weight of the polymeric suds boosters, determined via conventional gel permeation chromatography, is from about 1,000 to about 2,000,000, preferably from about 5,000 to about 1,000,000, more preferably from about 10,000 to about 750,000, more preferably from about 20,000 to about 500,000, even more preferably from about 35,000 to about 200,000. The polymeric suds stabilizer can optionally be present in the form of a salt, either an inorganic or organic salt, for example the citrate, sulfate, or nitrate salt of (NN-dimethylamino)alkyl acrylate ester.

One preferred polymeric suds stabilizer is (N,N-dimethylamino)alkyl acrylate esters, namely

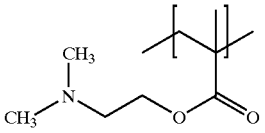

The composition will preferably contain at least about 0.01%, more preferably at least about 0.05%, even more preferably still, at least about 0.1% by weight of the composition of polymeric suds booster. The cleaning composition will also preferably contain no more than about 15%, more preferably no more than about 10%, even more preferably, no more than about 5% by weight of the composition of polymeric suds booster.

Thickener

The dishwashing detergent compositions herein can also contain from about 0.2% to 5% of a thickening agent. More preferably, such a thickener will comprise from about 0.5% to 2.5% of the compositions herein. Thickeners are typically selected from the class of cellulose derivatives. Suitable thickeners include hydroxy ethyl cellulose, hydroxyethyl methyl cellulose, carboxy methyl cellulose, Quatrisoft LM200, and the like. A preferred thickening agent is hydroxypropyl methylcellulose.

The composition will preferably contain at least about 0.1%, more preferably at least about 0.2%, even more preferably still, at least about 5% by weight of the composition of thickener. The composition will also preferably contain no more than about 5%, more preferably no more than about 3%, even more preferably, no more than about 2.5% by weight of the composition of thickener.

The hydroxypropyl methylcellulose polymer has a number average molecular weight of about 50,000 to 125,000 and a viscosity of a 2 wt. % aqueous solution at 25° C. (ADTMD2363) of about 50,000 to about 100,000 cps. An especially preferred hydroxypropyl cellulose polymer is Methocel® J75MS-N wherein a 2.0 wt. % aqueous solution at 25° C. has a viscosity of about 75,000 cps. Especially preferred hydroxypropyl cellulose polymers are surface treated such that the hydroxypropyl cellulose polymer will ready disperse at 25° C. into an aqueous solution having a pH of at least about 8.5.

When formulated into the dishwashing detergent compositions of the present invention, the hydroxypropyl methylcellulose polymer should impart to the detergent composition a Brookfield viscosity of from about 500 to 3500 cps at 25° C. More preferably, the hydroxypropyl methylcellulose material will impart a viscosity of from about 1000 to 3000 cps at 25° C. For purposes of this invention, viscosity is measured with a Brookfield LVTDV-11 viscometer apparatus using an RV #2 spindle at 12 rpm.

Solvents

A variety of water-miscible liquids such as lower alkanols, diols, other polyols, ethers, amines, and the like may be used Particularly preferred are the $C_1$–$C_4$ alkanols. Such solvents can be present in the compositions herein to the extent of from about 1% to 8%.

When present the composition will preferably contain at least about 0.01%, more preferably at least about 0.5%, even more preferably still, at least about 1% by weight of the composition of solvent. The composition will also preferably contain no more than about 20%, more preferably no more than about 10%, even more preferably, no more than about 8% by weight of the composition of solvent.

These solvents may be used in conjunction with an aqueous liquid carrier, such as water, or they may be used without any aqueous liquid carrier being present. Solvents are broadly defined as compounds that are liquid at temperatures of 20° C.–25° C. and which are not considered to be surfactants. One of the distinguishing features is that solvents tend to exist as discrete entities rather than as broad mixtures of compounds. Examples of suitable solvents for the present invention include, methanol, ethanol, propanol, isopropanol, 2-methyl pyrrolidinone, benzyl alcohol and morpholine n-oxide. Preferred among these solvents are methanol and isopropanol.

Suitable solvents for use herein include ethers and diethers having from 4 to 14 carbon atoms, preferably from 6 to 12 carbon atoms, and more preferably from 8 to 10 carbon atoms. Also other suitable solvents are glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols which can be used herein are according to the formula HO—CR1R2—OH wherein R1 and R2 are independently H or a C2–C10 saturated or unsaturated aliphatic hydrocarbon chain and/or cyclic. Suitable glycols to be used herein are dodecaneglycol and/or propanediol. Also suitable are polypropylene glycols, such as those with a molecular weigh in the range of about 100 to 1000. One suitable polypropylene glycol having a molecular weight of about 2700.

Suitable alkoxylated glycols which can be used herein are according to the formula R—(A)n—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols which can be used herein are according to the formula $R(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols which can be used herein are according to the formula R-OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols which can be used herein are according to the formula R-OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols which can be used herein are according to the formula $R(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols which can be used herein are according to the formula $R(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols which can be used herein are according to the formula R-OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include, but are not limited to, butyl diglycol ether (BDGE), butyltriglycol ether, ter amilic alcohol and the like. Particularly preferred solvents which can be used herein are butoxy propoxy propanol, butyl diglycol ether, benzyl alcohol, butoxypropanol, ethanol, methanol, isopropanol and mixtures thereof.

Other suitable solvents for use herein include propylene glycol derivatives such as n-butoxypropanol or n-butoxypropoxypropanol, water-soluble CARBITOL$^R$ solvents or water-soluble CELLOSOLVE$^R$ solvents; water-soluble CARBITOL$^R$ solvents are compounds of the 2-(2-alkoxyethoxy)ethanol class wherein the alkoxy group is derived from ethyl, propyl or butyl; a preferred water-soluble carbitol is 2-(2-butoxyethoxy)ethanol also known as butyl carbitol. Water-soluble CELLOSOLVE$^R$ solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, BUTYL CARBITOL® and mixtures thereof.

The solvents can also be selected from the group of compounds comprising ether derivatives of mono-, di- and tri-ethylene glycol, propylene glycol, butylene glycol ethers, and mixtures thereof. The molecular weights of these solvents are preferably less than 350, more preferably between 100 and 300, even more preferably between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename "Dowanol" and from the Arco Chemical Company under the tradename "Arcosolv". Other preferred solvents including mono- and di-ethylene glycol n-hexyl ether are available from the Union Carbide company.

Perfumes

Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of such ingredients. Finished perfumes typically comprise from about 0.01% to about 2%, by weight, of the detergent compositions herein, and individual perfumery ingredients can comprise from about 0.0001% to about 90% of a finished perfume composition.

Non-limiting examples of perfume ingredients useful herein include: 7-acetyl-1,2,3,4,5,6,7,8-octahydro-1,1,6,7-tetramethyl naphthalene; ionone methyl; ionone gamma methyl; methyl cedrylone; methyl dihydrojasmonate; methyl 1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; para-hydroxy-phenylbutanone; benzophenone; methyl beta-naphthyl ketone; 6-acetyl-1,1,2,3,3,5-hexamethyl indane; 5-acetyl-3-isopropyl-1,1,2,6-tetramethyl indane; 1-dodecanal, 4-(4-hydroxy-4-methylpentyl)-3-cyclohexene-1-carboxaldehyde; 7-hydroxy-3,7-dimethyl ocatanal; 10-undecen-1-al; iso-hexenyl cyclohexyl carboxaldehyde; formyl tricyclodecane; condensation products of hydroxycitronellal and methyl anthranilate, condensation products of hydroxycitronellal and indol, condensation products of phenyl acetaldehyde and indol; 2-methyl-3-(para-tert-butylphenyl)-propionaldehyde; ethyl vanillin; heliotropin; hexyl cinnamic aldehyde; amyl cinnamic aldehyde; 2-methyl-2-(para-iso-propylphenyl)-propionaldehyde; coumarin; decalactone gamma; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; beta-naphthol methyl ether; ambroxane; dodecahydro-3a,6,6,9a-tetramethylnaphtho[2,1b]furan; cedrol, 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; tricyclodecenyl propionate; tricyclodecenyl acetate; benzyl salicylate; cedryl acetate; and para-(tert-butyl)cyclohexyl acetate.

Particularly preferred perfume materials are those that provide the largest odor improvements in finished product compositions containing cellulases. These perfumes include but are not limited to: hexyl cinnamic aldehyde; 2-methyl-3-(para-tert-butylphenyl)-propionaldehyde; 7-acetyl-1,2,3,4,5,6,7,8-octahydro-1,1,6,7-tetramethyl naphthalene; benzyl salicylate; 7-acetyl-1,1,3,4,4,6-hexamethyl tetralin; para-tert-butyl cyclohexyl acetate; methyl dihydro jasmonate;

beta-napthol methyl ether; methyl beta-naphthyl ketone; 2-methyl-2-(para-iso-propylphenyl)-propionaldehyde; 1,3,4,6,7,8-hexahydro-4,6,6,7,8,8-hexamethyl-cyclopenta-gamma-2-benzopyrane; dodecahydro-3a,6,6,9a-tetramethylnaphtho[2,1b]furan; anisaldehyde; coumarin; cedrol; vanillin; cyclopentadecanolide; tricyclodecenyl acetate; and tricyclodecenyl propionate.

Other perfume materials include essential oils, resinoids, and resins from a variety of sources including, but not limited to: Peru balsam, Olibanum resinoid, styrax, labdanum resin, nutmeg, cassia oil, benzoin resin, coriander and lavandin. Still other perfume chemicals include phenyl ethyl alcohol, terpineol, linalool, linalyl acetate, geraniol, nerol, 2-(1,1-dimethylethyl)-cyclohexanol acetate, benzyl acetate, and eugenol. Carriers such as diethylphthalate can be used in the finished perfume compositions.

Chelating Agents

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetrace-tates, N-hydroxyethylethylenediaminetriacetates, nitrilotriacetates, ethylenediamine tetrapro-prionates, triethylenetetraaminehexacetates, diethylenetriaminepentaacetates, and ethanoldi-glycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from about 0.1% to about 15% by weight of the detergent compositions herein. More preferably, if utilized, the chelating agents will comprise from about 0.1% to about 3.0% by weight of such compositions.

The composition will preferably contain at least about 0.01%, more preferably at least about 0.1% by weight of the composition of chelating agent. The composition will also preferably contain no more than about 15%, more preferably no more than about 3% by weight of the composition of chelating agent.

Composition pH

Dishwashing compositions of the invention will be subjected to acidic stresses created by food soils when put to use, i.e., diluted and applied to soiled dishes. If a composition with a pH greater than 7 is to be more effective, it may optionally contain a buffering agent capable of providing a generally more alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 10. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are Tri (hydroxymethyl)amino methane (HOCH2)3CNH3 (TRIS), 2-amino-2-ethyl-1,3-propanediol, 2-amino-2-methyl-propanol, 2-amino-2-methyl-1,3-propanol, disodium glutamate, N-methyl diethanolamide, 1,3-diaminopropanol N,N'-tetra-methyl-1,3-diamino-2-propanol, N,N-bis(2-hydroxyethyl)glycine (bicine) and N-tris (hydroxymethyl) methyl glycine (tricine). Mixtures of any of the above are also acceptable. Useful inorganic buffers/alkalinity sources include the alkali metal carbonates and alkali metal phosphates, e.g., sodium carbonate, sodium polyphosphate. For additional buffers see McCutcheon's EMULSIFIERS AND DETERGENTS, North American Edition, 1997, McCutcheon Division, MC Publishing Company Kirk and WO 95/07971 both of which are incorporated herein by reference.

The composition will preferably contain at least about 0.1%, more preferably at least about 1%, even more preferably still, at least about 2% by weight of the composition of buffering agent. The composition will also preferably contain no more than about 15%, more preferably no more than about 10%, even more preferably, no more than about 8% by weight of the composition of buffering agent.

Hydrotropes

The aqueous liquid carrier may comprise one or more materials which are hydrotropes. Hydrotropes suitable for use in the compositions herein include the $C_1$–$C_3$ alkyl aryl sulfonates, $C_6$–$C_{12}$ alkanols, $C_1$–$C_6$ carboxylic sulfates and sulfonates, urea, $C_1$–$C_6$ hydrocarboxylates, $C_1$–$C_4$ carboxylates, $C_2$–$C_4$ organic diacids and mixtures of these hydrotrope materials. The liquid detergent composition of the present invention preferably comprises from about 0.5% to 8%, by weight of the liquid detergent composition of a hydrotrope selected from alkali metal and calcium xylene and toluene sulfonates.

Suitable $C_1$–$C_3$ alkyl aryl sulfonates include sodium, potassium, calcium and ammonium xylene sulfonates; sodium, potassium, calcium and ammonium toluene sulfonates; sodium, potassium, calcium and ammonium cumene sulfonates; and sodium, potassium, calcium and ammonium substituted or unsubstituted naphthalene sulfonates and mixtures thereof.

Suitable $C_1$–$C_8$ carboxylic sulfate or sulfonate salts are any water soluble salts or organic compounds comprising 1 to 8 carbon atoms (exclusive of substituent groups), which are substituted with sulfate or sulfonate and have at least one carboxylic group. The substituted organic compound may be cyclic, acylic or aromatic, i.e. benzene derivatives. Preferred alkyl compounds have from 1 to 4 carbon atoms substituted with sulfate or sulfonate and have from 1 to 2 carboxylic groups. Examples of this type of hydrotrope include sulfosuccinate salts, sulfophthalic salts, sulfoacetic salts, m-sulfobenzoic acid salts and diester sulfosuccinates, preferably the sodium or potassium salts as disclosed in U.S. Pat. No. 3,915,903.

Suitable $C_1$–$C_4$ hydrocarboxylates and $C_1$–$C_4$ carboxylates for use herein include acetates and propionates and citrates. Suitable $C_2$–$C_4$ diacids for use herein include succinic, glutaric and adipic acids.

Other compounds which deliver hydrotropic effects suitable for use herein as a hydrotrope include $C_6$–$C_{12}$ alkanols and urea.

Preferred hydrotropes for use herein are sodium, potassium, calcium and ammonium cumene sulfonate; sodium, potassium, calcium and ammonium xylene sulfonate; sodium, potassium, calcium and ammonium toluene sulfonate and mixtures thereof. Most preferred are sodium cumene sulfonate and calcium xylene sulfonate and mixtures thereof. These preferred hydrotrope materials can be present in the composition to the extent of from about 0.5% to 8% by weight.

It has been further surprisingly found that when a hydrotrope is present in the composition of the present invention at least about 4.5% by weight, then the composition is found to have antibacterial properties. That is, the presence of the hydrotrope in at least about 4.5% by weight, means the compositions of the present invention will noticeably reduce the level of bacteria present on a surface when directly applied to the surface.

The composition will preferably contain at least about 0.1%, more preferably at least about 0.2%, even more preferably still, at least about 0.5% by weight of the composition of hydrotrope. The composition will also preferably contain no more than about 15%, more preferably no more than about 10%, even more preferably, no more than about 8% by weight of the composition of hydrotrope.

Other Ingredients

The detergent compositions will further preferably comprise one or more detersive adjuncts selected from the following: soil release polymers, polymeric dispersants, polysaccharides, abrasives, bactericides, tarnish inhibitors, dyes, antifungal or mildew control agents, insect repellents, hydrotropes, processing aids, suds boosters, brighteners, anti-corrosive aids and stabilizers antioxidants. A wide variety of other ingredients useful in detergent compositions can be included in the compositions herein, including other active ingredients, carriers, antioxidants, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl-4-methylphenol (BHT), carbamate, ascorbate, thiosulfate, monoethanolamine(MEA), diethanolamine, triethanolamine, etc. It is preferred that the antioxidant, when present, be present in the composition from about 0.001% to about 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Form of the Composition

The compositions herein can be in any of the conventional forms for hand dishwashing compositions, such as, paste, liquid, granule, powder, gel, and mixtures thereof. Highly preferred embodiments are in liquid or gel form. The liquid compositions can be either aqueous or nonaqueous. When the composition is a aqueous liquid the composition will preferably further contain an aqueous liquid carrier in which the other essential and optional compositions components are dissolved, dispersed or suspended.

When the composition is an aqueous liquid the composition will preferably contain at least about 5%, more preferably at least about 10%, even more preferably still, at least about 30% by weight of the composition of aqueous liquid carrier. The composition will also preferably contain no more than about 95%, more preferably no more than about 60%, even more preferably, no more than about 50% by weight of the composition of aqueous liquid carrier.

One essential component of the aqueous liquid carrier is, of course, water. The aqueous liquid carrier, however, may contain other materials which are liquid, or which dissolve in the liquid carrier, at room temperature and which may also serve some other function besides that of a simple filler. Such materials can include, for example, hydrotropes and solvents. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used.

An example of the procedure for making granules of the detergent compositions herein is as follows:—Linear aklylbenzenesulfonate, citric acid, sodium silicate, sodium sulfate perfume, diamine and water are added to, heated and mixed via a crutcher. The resulting slurry is spray dried into a granular form.

An example of the procedure for making liquid detergent compositions herein is as follows:—To the free water and citrate are added and dissolved. To this solution amine oxide, betaine, ethanol, hydrotrope and nonionic surfactant are added. If free water isn't available, the citrate are added to the above mix then stirred until dissolved. At this point, an acid is added to neutralize the formulation. It is preferred that the acid be chosen from organic acids such as maleic and citric, however, inorganic mineral acids may be employed as well. In preferred embodiments these acids are added to the formulation followed by diamine addition. AExS is added last.

Non-Aqueous Liquid Detergents

The manufacture of liquid detergent compositions which comprise a non-aqueous carrier medium can be prepared according to the disclosures of U.S. Pat. Nos. 4,753,570; 4,767,558; 4,772,413; 4,889,652; 4,892,673; GB-A-2,158,838; GB-A-2,195,125; GB-A-2,195,649; U.S. Pat. Nos. 4,988,462; 5,266,233; EP-A-225,654 (Jun. 16, 1987); EP-A-510,762 (Oct. 28, 1992); EP-A-540,089 (May 5, 1993); EP-A-540,090 (May 5, 1993); U.S. Pat. No. 4,615,820; EP-A-565,017 (Oct. 13, 1993); EP-A-030,096 (Jun. 10, 1981), incorporated herein by reference. Such compositions can contain various particulate detersive ingredients stably suspended therein. Such non-aqueous compositions thus comprise a LIQUID PHASE and, optionally but preferably, a SOLID PHASE, all as described in more detail hereinafter and in the cited references.

The compositions of this invention can be used to form aqueous washing solutions for use hand dishwashing. Generally, an effective amount of such compositions is added to water to form such aqueous cleaning or soaking solutions. The aqueous solution so formed is then contacted with the dishware, tableware, and cooking utensils.

An effective amount of the detergent compositions herein added to water to form aqueous cleaning solutions can comprise amounts sufficient to form from about 500 to 20,000 ppm of composition in aqueous solution. More preferably, from about 800 to 5,000 ppm of the detergent compositions herein will be provided in aqueous cleaning liquor.

The following examples are illustrative of the present invention, but are not meant to limit or otherwise define its scope. All parts, percentages and ratios used herein are expressed as percent weight unless otherwise specified.

In the following Examples all levels are quoted as % by weight of the composition.

EXAMPLES

| | Example 1 | Example 2 | Example 3 | Example 4 | Example 5 |
|---|---|---|---|---|---|
| AE0.6S[1] | 26 | 26 | 26 | 26 | 26 |
| Amine oxide[2] | 6.5 | 6.5 | 7.5 | 7.5 | 7.5 |
| C10E8[6] | 3 | 3 | 4.5 | 4.5 | 4.5 |
| Diamine[5] | 0.5 | 0.5 | 1.25 | 0 | 1.25 |
| Diamine[7] | 0 | 0 | 0 | 1 | |
| Magnesium salt[8] | 0.4 | 0.4 | 1.0 | 1.0 | 0.2 |
| Suds boosting polymer[3] | 0 | 0.2 | 0.5 | 0.2 | 0.5 |
| Sodium cumene sulphonate | 1.5 | 1.5 | 1 | 1 | 1 |
| Ethanol | 8 | 8 | 8 | 8 | 8 |
| Sodium Chloride | 0.5 | 0.5 | 0 | 0 | 0.2 |
| pH | 9 | 9 | 9 | 8 | 10 |
| Molar ratio anionic: amine oxide: diamine | 27:8:1 | 27:8:1 | 11:3.5:1 | 11:3.5:1 | 11:3.5:1 |

TABLE II

| | Example 6 | Example 7 | Example 8 | Example 9 |
|---|---|---|---|---|
| AE0.6S[1] | 26.09 | 26.09 | 26.09 | 28.80 |
| Amine oxide[2] | 6.50 | 6.50 | 6.50 | 7.20 |
| Suds boosting polymer[3] | 0.20 | 0.20 | 0.20 | 0.22 |
| Sodium Cumene Sulfonate | 1.50 | 1.50 | 3.50 | 2.0 |
| Polypropylene glycol (MW 2700) | 1 | 1 | 1 | 1 |
| C10E8 | 3.00 | 3.00 | 3.00 | 3.30 |
| Diamine[5] | 0.50 | 0.50 | 0.50 | 0.50 |
| Magnesium Salt[8] | 0.22 | 0.1 | 0.5 | 0.4 |
| Sodium chloride | 0.5 | — | 0.5 | — |
| Water and Misc. | BAL. | BAL. | BAL. | BAL. |
| Viscosity (cps @ 70 F.) | 150 | 330 | 650 | 330 |
| pH @ 10% | 8.3 | 9.0 | 9.0 | 9.0 |
| Molar ratio anionic:amine oxide:diamine | 27:8:1 | 27:8:1 | 27:8:1 | 11:3.5:1 |

TABLE I

| | Example 10 | Example 11 | Example 12 | Example 13 |
|---|---|---|---|---|
| AE0.6S[1] | 28.80 | 28.80 | 26.00 | 26.00 |
| Amine oxide[2] | 7.20 | 7.20 | 6.5 | 6.5 |
| Citric acid | 3.00 | — | — | — |
| Maleic acid | — | 2.50 | — | — |
| Magnesium Salt[7] | 0.22 | 0.1 | 0.04 | 0.04 |
| Sodium chloride | 0.5 | — | 0.6 | 0.6 |
| Suds boosting polymer[3] | 0.22 | 0.22 | 0.20 | 0.2 |
| Sodium Cumene Sulfonate | 3.30 | 3.30 | 2 | 2 |
| Ethanol | 6.50 | 6.50 | — | — |
| Polypropylene glycol (MW 2700) | — | — | 1.5 | 1.5 |
| C10E8[8] | — | — | 3.0 | 3.0 |
| C11E9[4] | 3.33 | 3.33 | — | — |
| Diamine[5] | 0.55 | 0.55 | 0.5 | 0.5 |
| Protease | — | — | 0.009 | 0.012 |
| Perfume | 0.31 | 0.31 | 0.32 | 0.32 |
| Water and minors | BAL. | BAL. | BAL. | BAL. |
| Viscosity (cps @ 70 F.) | 330 | 330 | 330 | 330 |
| pH @ 10% | 9.0 | 9.0 | 9.0 | 9.0 |
| Molar ratio anionic:amine oxide:diamine | 11:3.5:1 | 11:3.5:1 | 27:8:1 | 27:8:1 |

[1]: C12–13 alkyl ethoxy sulfonate containing an average of 0.6 ethoxy groups.
[2]: $C_{12}$—$C_{14}$ Amine oxide.
[3]: Polymer is (N,N-dimethylamino)ethyl methacrylate homopolymer
[4]: C11 Alkyl ethoxylated surfactant containing 9 ethoxy groups.
[5]: 1,3 bis(methylamine)-cyclohexane.
[6]: C10 Alkyl ethoxylated surfactant containing 8 ethoxy groups.

TABLE I-continued

| | Example 10 | Example 11 | Example 12 | Example 13 |
|---|---|---|---|---|

[7]: Magnesium salt is selected from Magnesium sulfate, magnesium hydroxide, magnesium chloride and mixtures thereof.
[8]: 10 Alkyl ethoxylated surfactant containing 8 ethoxy groups.

What is claimed is:

1. A hand dishwashing detergent composition comprising:

a) a low molecular weight organic diamine having a pK1 and a pK2, wherein the pK1 and the pK2 of said diamine are both in the range of from about 8.0 to about 11.5;

b) an anionic surfactant;

c) an amine oxide;

d) magnesium ions; and e) a polymeric suds stabilizer selected from the group consisting of:

i) homopolymers of (N,N-dialkylamino)alkyl acrylate esters having the formula:

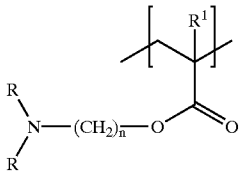

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

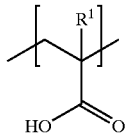

wherein R1 is hydrogen, C1–C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons;

wherein the pH as measured as 10% aqueous solution is from about 5.0 to about 12.5; wherein said magnesium ions are present at an equimolar or less than equimolar amount of said diamine; and wherein the mole ratio of said anionic surfactant to said amine oxide to said diamine is from about 100:40:1 to about 9:0.5:1.

2. A hand dishwashing detergent composition comprising:

a) from about 0.1% to about 15%, by weight of an organic diamine having a molecular weight less than or equal to 400 g/mol;

b) an anionic surfactant;

c) amine oxide;

d) from about 0.01% to about 5% by weight of magnesium ions;

e) less than about 1% by weight of sodium chloride; and f) a polymeric suds stabilizer selected from the group consisting of:

i) homopolymers of (N,N-dialkylamino)alkyl acrylate esters having the formula:

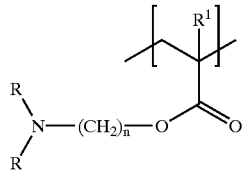

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

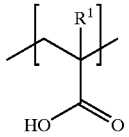

wherein R1 is hydrogen, C1–C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons;

wherein the pH as measured as 10% aqueous solution is from about 5.0 to about 12.5; wherein said magnesium ions are present at an equimolar or less than equimolar amount of said diamine; and wherein the mole ratio of said anionic surfactant to said amine oxide to said diamine is from about 100:40:1 to about 9:0.5:1.

3. An anti-bacterial hand dishwashing detergent composition comprising:

a) a low molecular weight organic diamine having a pK1 and a pK2, wherein the pK1 and the pK2 of said diamine are both in the range of from about 8.0 to about 11.5;

b) an anionic surfactant;

c) an amine oxide;

d) magnesium ions;

e) from about 4.5% to about 15% by weight of a hydrotrope; and f) a polymeric suds stabilizer selected from the group consisting of:

i) homopolymers of (N,N-dialkylamino)alkyl acrylate esters having the formula:

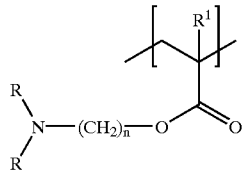

wherein each R is independently hydrogen, $C_1$–$C_8$ alkyl, and mixtures thereof, $R^1$ is hydrogen, $C_1$–$C_6$ alkyl, and mixtures thereof, n is from 2 to about 6; and ii) copolymers of (i) and

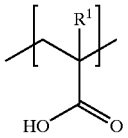

wherein R1 is hydrogen, C1–C6 alkyl, and mixtures thereof; provided that the ratio of (ii) to (i) is from about 2 to 1 to about 1 to 2; and wherein said polymeric suds stabilizer has a molecular weight of from about 1,000 to about 2,000,000 daltons;

wherein the pH as measured as 10% aqueous solution is from about 5.0 to about 12.5; wherein said magnesium ions are present at an equimolar or less than equimolar amount of said diamine and wherein the mole ratio of said anionic surfactant to said amine oxide to said diamine is from about 100:40:1 to about 9:0.5:1.

4. A hand dishwashing detergent composition according to claim 3 further comprising a surfactant, wherein said surfactant is selected form the group consisting nonionic, amphoteric, zwitterionic and mixtures thereof.

5. A hand dishwashing detergent composition according to claim 4 wherein said diamine is selected from the group consisting of:

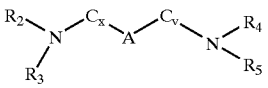

wherein $R_{2-5}$ are independently selected from H, methyl, ethyl, and ethylene oxides; $C_x$ and $C_v$ are independently selected from methylene groups or branched alkyl groups where x+v is from 3 to 6; and A is optionally present and is selected from electron donating or withdrawing moieties chosen to adjust the diamine pKa's to the desired range; wherein if A is present, then both x and y must be 2 or greater.

6. A detergent composition according to claim 4 wherein said diamine has the formula:

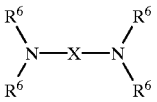

wherein each $R^6$ is independently selected from the group consisting of hydrogen, $C_1$–$C_4$ linear or branched alkyl, alkyleneoxy having the formula:

$$—(R^7O)_mR^8$$

wherein $R^7$ is $C_2$–$C_4$ linear or branched alkylene, and mixtures thereof; $R^8$ is hydrogen, $C_1$–$C_4$ alkyl, and mixtures thereof; m is from 1 to 10; X is a unit selected from:

i) $C_3$–$C_{10}$ linear alkylene, $C_3$–$C_{10}$ branched alkylene, $C_3$–$C_{10}$ cyclic alkylene, $C_3$–$C_{10}$ branched cyclic alkylene, an alkyleneoxyalkylene having the formula:

$$—(R^7O)_mR^7—$$

wherein $R^7$ and m are the same as defined herein above;

ii) $C_3$–$C_{10}$ linear, $C_3$–$C_{10}$ branched linear, $C_3$–$C_{10}$ cyclic, $C_3$–$C_{10}$ branched cyclic alkylene, $C_6$–$C_{10}$ arylene, wherein said unit comprises one or more electron donating or electron withdrawing moieties which provide said diamine with a $pK_a$ greater than 8; and iii) mixtures of (i) and (ii) provided said diamine has a $pK_a$ of at least 8.

7. A hand dishwashing detergent composition according to claim 6 wherein said diamine is selected from the group consisting of dimethyl aminopropyl amine, 1,6-hexane diamine, 1,3 propane diamine, 2-methyl 1,5 pentane diamine, 1,3-Pentanediamine, 1,3-diaminobutane, 1,2-bis(2-aminoethoxy)ethane, Isophorone diamine, 1,3-bis (methylamine)-cyclohexane and mixtures thereof.

8. A hand dishwashing detergent composition according to claim 7 wherein said anionic surfactant is selected from the group consisting of alkyl sulfates, alkyl alkoxy sulfates, linear alkylbenzene sulfonate, alpha olefin sulfonate, paraffin sulfonates, methyl ester sulfonates, alkyl sulfonates, alkyl alkoxylated sulfates, sarcosinates, taurinates, alkyl alkoxy carboxylate, and mixtures thereof.

9. A hand dishwashing detergent composition according to claim 1 further comprising an enzyme, wherein said enzyme is selected from the group consisting of amylase, protease, cellulase, lipase and mixtures thereof.

10. A hand dishwashing detergent composition according to claim 9 further comprising one or more detersive adjuncts selected from the following: soil release polymers, polymeric dispersants, hydrotrope, polysaccharides, thickeners, abrasives, bactericides, tarnish inhibitors, builders, enzymes, dyes, perfumes, thickeners, antioxidants, processing aids, suds boosters, buffers, antifungal or mildew control agents, insect repellants, anti-corrosive aids, and chelants.

11. A hand dishwashing detergent composition according to claim 10 wherein said composition is in the form selected from the group consisting of paste, liquid, granule, powder, gel, and mixtures thereof.

12. A hand dishwashing detergent composition according to claim 11 wherein the mole ratio of anionic surfactant:amine oxide:diamine is from 27:8:1 to 11:3:1.

13. An anti-bacterial hand dishwashing detergent composition according to claim 3 wherein said hydrotrope is selected form the group consisting of sodium, potassium, calcium and ammonium cumene sulfonate; sodium, potassium, calcium and ammonium xylene sulfonate; sodium, potassium, calcium and ammonium toluene sulfonate and mixtures thereof.

14. A method of washing tableware said method comprising contacting soiled tableware in need of cleaning with an aqueous solution of the hand dishwashing detergent composition according to claim 13.

15. A hand dishwashing detergent composition according to claim 4 wherein said amphoteric surfactant is selected from the group consisting of betaines, sulfobetaines, and mixtures thereof.

16. A hand dishwashing detergent composition according to claim 1 wherein said composition has a viscosity of greater than 100 cps when measured by a Brookfield LVTDV-11 viscometer apparatus using an RV #2 spindle at 12 rpm.

17. An anti-bacterial hand dishwashing detergent composition according to claim 3 wherein said hydrotrope is selected form the group consisting of sodium, potassium, calcium and ammonium cumene sulfonate; sodium, potassium, calcium and ammonium xylene sulfonate; sodium, potassium, calcium and ammonium toluene sulfonate and mixtures thereof.

* * * * *